United States Patent [19]

Klomp et al.

[11] 4,174,778

[45] Nov. 20, 1979

[54] PACKAGE FOR TUBULAR LAMP

[75] Inventors: Franciscus M. Klomp; Josephus H. van Kruijsdijk, both of Eindhoven, Netherlands

[73] Assignee: U.S. Philips Corporation, New York, N.Y.

[21] Appl. No.: 899,068

[22] Filed: Apr. 24, 1978

[30] Foreign Application Priority Data

Jun. 14, 1977 [NL] Netherlands ..... 7706511

[51] Int. Cl.[2] ..... B65D 85/02

[52] U.S. Cl. ..... 206/303; 206/418; 206/482

[58] Field of Search ..... 206/418, 303, 397, 396, 206/482; 229/87 H

[56] References Cited

U.S. PATENT DOCUMENTS

| | | | |
|---|---|---|---|
| 2,620,062 | 12/1952 | Schuler | 206/320 |
| 3,337,035 | 8/1967 | Pennybacker | 206/418 |
| 3,446,419 | 5/1969 | Mueller | 206/397 |
| 3,910,409 | 10/1975 | Fortlage | 206/303 |

*Primary Examiner*—William T. Dixson, Jr.

*Attorney, Agent, or Firm*—Thomas A. Briody; William J. Streeter; Rolf E. Schneider

[57] ABSTRACT

A package consisting of a plate-shaped support on which a tubular lamp is connected. The lamp is enclosed in sheath-like cavities which are formed by lugs which are cut out of the support and which are folded out of the plane of the support and are connected with their free ends to the support or to flaps of the support provided opposite to the lugs.

4 Claims, 4 Drawing Figures

PACKAGE FOR TUBULAR LAMP

Figure 1:
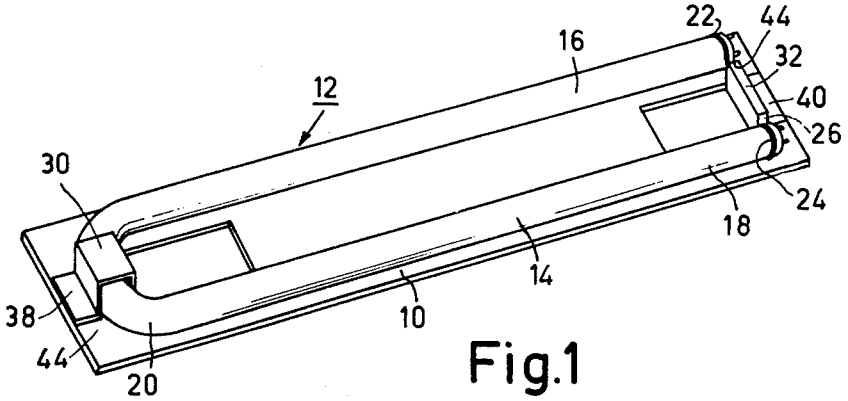

This invention relates to a package comprising a plate-shaped support member holding a tubular lamp in particular a low-pressure mercury vapour discharge lamp, the support member including cut-out lugs each one of which is folded out of the plane of the support member along a score line at its fixed end. Such a package is known from German Gebrauchsmuster 7,149,118.

The known package is used to protect tubular discharge lamps of which the lamp envelope has a U-shape or is of a circular shape. The lamp is accommodated between the cut-out lugs and folded edges of the support member and is connected to the support member by a foil which is tensioned over the lamp and the free ends of the lugs and which is attached to a folded edge of the support member. A disadvantage of the known package is that the coherence and stability of the whole package are determined to a considerable extent by the properties of the foil.

It is an object of the present invention to provide a package in which the tubular lamp can be rigidly connected to the plate-shaped support member without the use of a foil.

According to the invention, there is provided a package comprising a plate-shaped support member holding a tubular lamp, in particular a low pressure mercury vapour discharge lamp, the support member including cut-out lugs each one of which is folded out of the plane of the support member along a score line at its fixed end, in which the lugs are connected with their free ends to the support member or to flaps of the support member formed by a score line provided opposite to the lugs, so that sheath-like cavities are formed which enclose the tubular lamp.

The packaging of the lamp is carried out by bending the cut-out lug around the part of the lamp present at that area and fixing the free end of the lug while forming the sheath-like cavity. In the case of a long lug which can surround the lamp substantially entirely, this is done by connecting the free end to the support member. In the case of shorter lugs, flap is used which is bent around the lamp and to which the free end is connected. As connection means rivets or adhesives may be used.

An advantage of the package of the invention is that it is formed from a small area of the packaging material so that the cost of the package is low. Furthermore, the packaged lamp is enclosed in the sheath-like cavities in an efficacious and rigid manner, the walls of said cavities being slightly resilient so that the lamp is protected against shocks and impacts.

Some examples of packaging material include solid fiber board, for example duplexboard and strawboard, or corrugated board.

In one embodiment wherein the lamp has a U-shaped envelope the limbs of which are connected at their free ends by a reinforcement strap, the support member has two lugs cut out of the part of the support member present between the limbs of the lamp envelope, one lug being bent around the lamp envelope at the area of the bend therein and the other lug being bent around the reinforcement strap, both lugs being connected to the support member with their free ends. As a result of this choice of the place of the lugs, the lamp is fixed to the support member both in the longitudinal and in the transverse directions. Furthermore, the dimensions of the support member may be substantially equal to the dimensions of the outline of the lamp.

In a different embodiment wherein the lamp has a circular envelope, the support member has four lugs cut out at regular distances from each other and the score line of each of which is situated along the inner edge of the lamp envelope, and the support member is provided, opposite to the lugs, with flaps folded out of the plane of the support member and the score line of each of which is situated along the outer edge of the lamp envelope, to which flaps the lugs are connected with their free ends. Said package may consist of a square support member the corner portions of which are in the form of flaps and in which a lug is cut out opposite to each flap.

The oppositely located lugs and flaps are preferably proportioned so as to overlap each other as a result of which they can easily be connected together, for example by means of an adhesive. When the length of the lugs and flaps is chosen to be equal to at most twice the diameter of the lamp envelope, the dimensions of the support member may be adapted to the outside dimensions of the lamp without a significant loss of material occurring.

Figure 2:
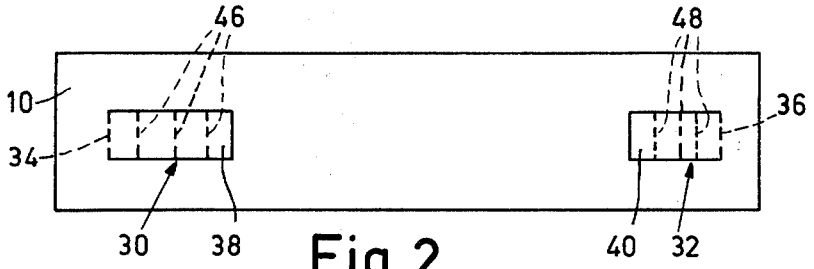
Figure 3:
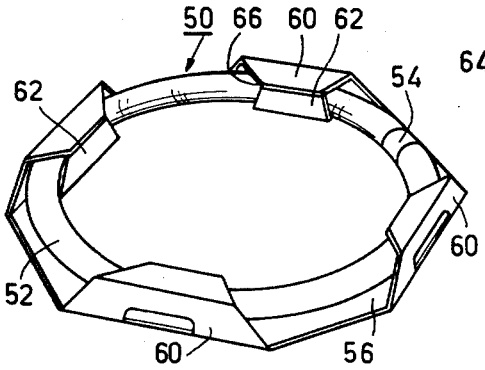
Figure 4:
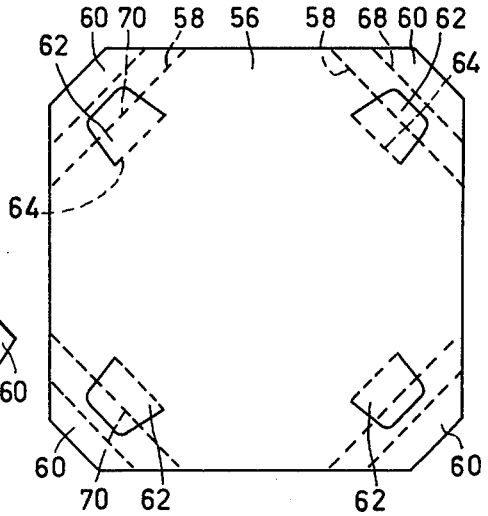

By way of example, an embodiment of the invention will now be described in greater detail with reference to the accompanying drawing, in which FIG. 1 is a perspective view of a discharge lamp having a U-shaped envelope packaged according to the invention, FIG. 2 is a plan view of the plate-shaped support member to be used in the package shown in FIG. 1, FIG. 3 is a perspective view of a discharge lamp having a circular envelope packaged according to the invention, and FIG. 4 is a plan view of the plate-shaped support member to be used in the package shown in FIG. 3.

The package according to the invention shown in FIG. 1 comprises an elongate plate-shaped support member 10 of corrugated board on which a low pressure mercury vapour discharge lamp 12 is secured the envelope 14 of which is bent in the form of a U. The two limbs 16 and 18 of the envelope are connected together by a bend 20 and comprise at their free ends connection caps 22 and 24, respectively, having contact pins. The lamp 12 is reinforced mechanically by a metal strap 26 which secures the connection caps 22 and 24 together. In a part of the support member 10 located between the limbs 16 and 18, two lugs 30 and 32 are cut out in the region of the bend 20 and the reinforcement strap 26, as is shown in FIG. 2. The lugs 30 and 32 at their fixed ends have score lines 34 and 36, respectively. For connecting the lamp 12 to the support member, the lugs 30 and 32 are folded out of the plane of the support member along the score lines 34 and 36, respectively, and then bent around the bend 20 and the strap 26, respectively, and are connected to the support member with their free ends 38 and 40, respectively. As a result of this the lamp is enclosed in the formed sheath-like cavities 44. In order to facilitate the bending of the lugs 30 and 32, they are each provided with three score lines 46 and 48, respectively.

FIG. 3 shows a low-pressure mercury vapour discharge lamp 50 having a circular envelope 52 packaged according to the invention. The discharge lamp 50 which has a lamp cap 54 with contact pins between the ends of the lamp envelope 52 is connected to a plate-shaped support member 56. The support member 56 is formed from a rectangular sheet of solid fibreboard, as shown in FIG. 4. The corner portions of the support member 56 are formed as flaps 60 by score lines 58. Opposite to the flaps 60, lugs 62 are cut out in the support member 56 which lugs 62 have a score line 64 at their fixed end. Before connecting the lamp 50 to the support member 56 thus formed, each lug is bent out of the plane of the support member along its score line or crease 64. The lamp is then placed on the support member 56 between the score lines or creases 58 and 64, the score lines 58 being situated at the outer edge and the score lines 64 being situated at the inner edge of the lamp envelope 52. The flaps 60 and the lugs 62 are then bent around the lamp envelope so that they overlap each other partly and are connected together. As a result of this the circular lamp 50 is enclosed in the formed sheath-like cavities 66. In order to facilitate the bending of the flaps 60 and the lugs 62 they are provided with extra score lines or creases 68 and 70, respectively.

What is claimed is:

1. A package for a tubular lamp, comprising a flat support member, at least two substantially parallel first creases in said support member, a substantially U-shaped score mark through said support member and encompassing a portion of at least one of said creases, and a further crease across the open ends of said U-shaped score mark, all portions of the flat support member with the exception of the portion encompassed by said score mark being bent along said creases in the same angular direction during packaging, the portion of said support member between the crease encompassed by the score mark and the closed end of the score mark being bent in the opposite direction.

2. A package as recited in claim 1, wherein all of the creases are separated by a distance exceeding the thickness of said tubular lamp by at most twice the thickness of said tubular lamp.

3. A package as recited in claim 1, wherein the portion of the crease encompassed by the score mark and bent in said opposite direction is connected to a scored portion of the support member that is bent in said direction to form a sleeve surrounding said lamp.

4. A package as recited in claim 1, wherein the lamp is circular, and wherein the support member is generally square, the first crease marks extending diagonally across each corner of said support member, and wherein the open ends of the U-shaped score marks face away from each corner of the support member.

* * * * *